United States Patent [19]

Tanaka et al.

[11] Patent Number: 4,993,203

[45] Date of Patent: Feb. 19, 1991

[54] FIREPROOF FRAME STRUCTURE IN A BUILDING OPENING PORTION

[75] Inventors: Kiyoshi Tanaka, Kawasaki; Kazushige Hori, Narashino, both of Japan

[73] Assignee: Mitsui Wood Products, Inc., Tokyo, Japan

[21] Appl. No.: 428,762

[22] Filed: Oct. 30, 1989

[51] Int. Cl.[5] ..... E04C 2/00

[52] U.S. Cl. ..... 52/232; 52/656

[58] Field of Search ..... 52/232, 220, 221, 202, 52/656

[56] References Cited

U.S. PATENT DOCUMENTS

| | | | |
|---|---|---|---|
| 2,593,050 | 4/1952 | Paul et al. | 52/232 |
| 2,910,739 | 11/1959 | Snitker | 52/232 X |
| 3,566,541 | 3/1971 | Coulter | 52/232 X |
| 3,566,564 | 3/1971 | Gaeth et al. | 52/232 |
| 3,955,330 | 5/1976 | Wendt | 52/232 X |
| 4,850,173 | 7/1989 | Beyer et al. | 52/232 X |

*Primary Examiner*—David A. Scherbel
*Assistant Examiner*—Linda J. Hoffert
*Attorney, Agent, or Firm*—Fleit, Jacobson, Cohn, Price, Holman & Stern

[57] ABSTRACT

A structure of a fireproof frame for building opening portions wherein a groove is formed over the entire circumference of a wood frame, which is disposed to a building opening portion, at the surface abutted against an opening member. A non-combustible heat forming sealing material is filled in the groove and the surface of the sealing material is covered with a thin film, which is excellent in heat conductivity, by means of the self bondability of said sealing material.

3 Claims, 3 Drawing Sheets

FIREPROOF FRAME STRUCTURE IN A BUILDING OPENING PORTION

BACKGROUND OF THE INVENTION 1. (Field of the Invention)

The present invention relates to a structure of a fireproof frame for building opening portions such as openings for windows, doors, etc.

2. (Description of the Prior Art)

A wood frame which has been used in the past as a frame for an opening portion has an appearance of beautiful wood grain and is excellent in fabricability and heat retaining property, but it has a fatal drawback of being burnt out or spreading fire upon fire accident. Therefore, it can not be used as a fireproof frame for buildings.

In view of the above, conventional structure of a fireproof frame for the opening portion employed usually comprises frames made of iron, aluminum or inorganic substance combined with heat insulating material or fireproof material, or further applied with surface decoration by appending thin wood veneer or applying printing or painting.

Although a fireproof frame made of metal is effective for preventing fire, it involves drawbacks that effective heat insulation is difficult due to heat or cold bridges present in connection portions and that a frame made of inorganic substance is poor in fabricability and can not firmly retain nails or screws for attaching auxiliary parts.

SUMMARY OF THE INVENTION

An object of the present invention is to provide a new fireproof frame structure for a building opening portion, which provides an effective heat insulation.

Another object of the present invention is to provide a new fireproof frame structure for a building opening portion, which permits an advantageous effect of preventing the discharge of smoke.

The foregoing drawbacks in the prior art can be overcome according to the present invention by a structure of a fireproof frame for building opening portions wherein a groove is formed over the entire circumference of a wood frame, which is disposed to a building opening portion in a facewise abutment relation, at the surface abutted against an opening member, a non-combustible heat foaming sealing material is filled in the groove and the surface of the sealing material is covered with a thin film, which is excellent in heat conductivity, by means of the self bondability of the sealing material while the material remains uncured.

As the thin film described above, those easily broken by the foaming pressure of the sealing material upon heating are preferred.

The sealing material as described above is, for example, caulking material mainly composed of non-combustible heat-foaming material, which has characteristics of self-adhesion when it is filled under pressure to the bottom of the groove and solidifies with lapse of time.

In the wood frame constituted as described above according to the present invention, when an opening member such as a door or window is heated, the heat is transferred and diffused at once to the entire circumference of the wood frame by way of the thin film covering the sealing material and the sealing material filled in the entire circumference of the wood frame is heated substantially uniformly. Then, when the temperature at the gap between the wood frame and the door or window reaches the foaming temperature of the sealing material upon fire accident, the sealing material is heated and foamed substantially simultaneously over the entire circumference of the wood frame and, as a result, the entire gap between the door or window and the wood frame is sealed with the non-combustible foams.

Further, the thin film used as the outer covering for the sealing material also has a function of preventing the aging change of the sealing material thereby improving the durability, and it has a further function of preventing stickiness and providing beautiful appearance.

Furthermore, since the wood frame is used as described above, fabricability is excellent, nails etc. can be fixed firmly and properties of heat insulation and heat retaining are also excellent.

DESCRIPTION OF THE PREFERRED EMBODIMENT

A preferred embodiment of the present invention will be described specifically with reference to the attached drawings.

Figure 1:
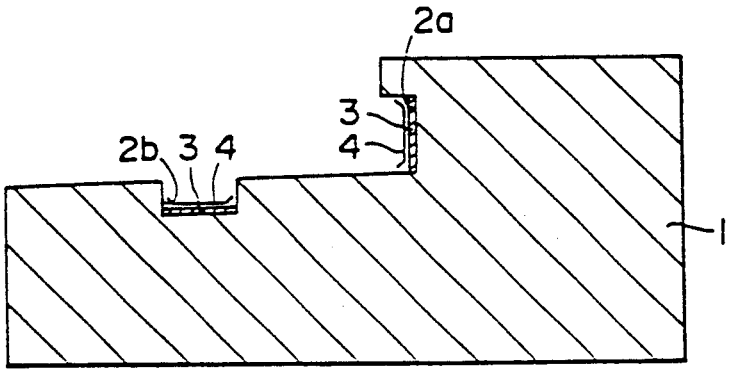
FIG. 1 is a cross sectional view for a portion of a wood frame in one embodiment according to the present invention.

In FIG. 1, a wood frame 1 was prepared from a 40 mm width×90 mm depth rectangular wood made of western hemlock by one surface of a side end as a doorstop of an L-shaped cross section, and grooves 2*a* and 2*b* each of 10 mm width×5 mm depth are formed at the entire circumference of two surfaces of the wood frame 1, which abut against an opening member. The illustrated groove has a combination of L-shaped and inverted L-shaped cross section (i.e., a U-shaped cross section with a flat bottom surface) but it may have V-shaped, U-shaped or semicircular cross section. Further, it is apparent that another groove may be formed at the center on a flat bottom surface of the U-cross-sectioned groove and the like.

Sealing material 3 mainly composed of sodium is filled under pressure and deposited at the bottom of the groove 2*a* and 2*b* respectively. Instead of sodium silicate, other non-combustible heat foaming inorganic substance can be used, for example, perlite or vermiculite. A thin film 4 made of an aluminum foil of 0.083 mm thickness×12 mm width is covered tightly over the surface of the sealing material 3, and the thin film 4 is bonded to the surface of the sealing material 3 by means of self adhesion of the sealing material 3. Any material may be used for the thin film 4 so long as it is excellent in heat conductivity and, preferably, easy to be broken by the foaming pressure of the sealing material, and it may be a single-layered or multi-layered material.

A heating test was conducted using the wood frame of the present invention having the construction as described above by the following procedures.

That is, a wood frame of the present invention and a comparative wood frame which is the same as the former except for deleting the step of applying an aluminum foil to the surface of the sealing material were disposed to a wall specimen 5 and a door specimen 6 having a facing material made of non-combustible materal and wood core, as shown in FIGS. 2(A) to 2(D). The wall specimen S and the door specimen 6 were used together for heating test. When a heating test was conducted for one hour in accordance with the fire-resistance standard heating curve based on JIS (Japanese Industrial Standards) A 1311 "Method of Fire Protecting Test of Fire Door for Buildings", the results shown in FIG. 3 and the Table 1 were obtained.

Figure 3:
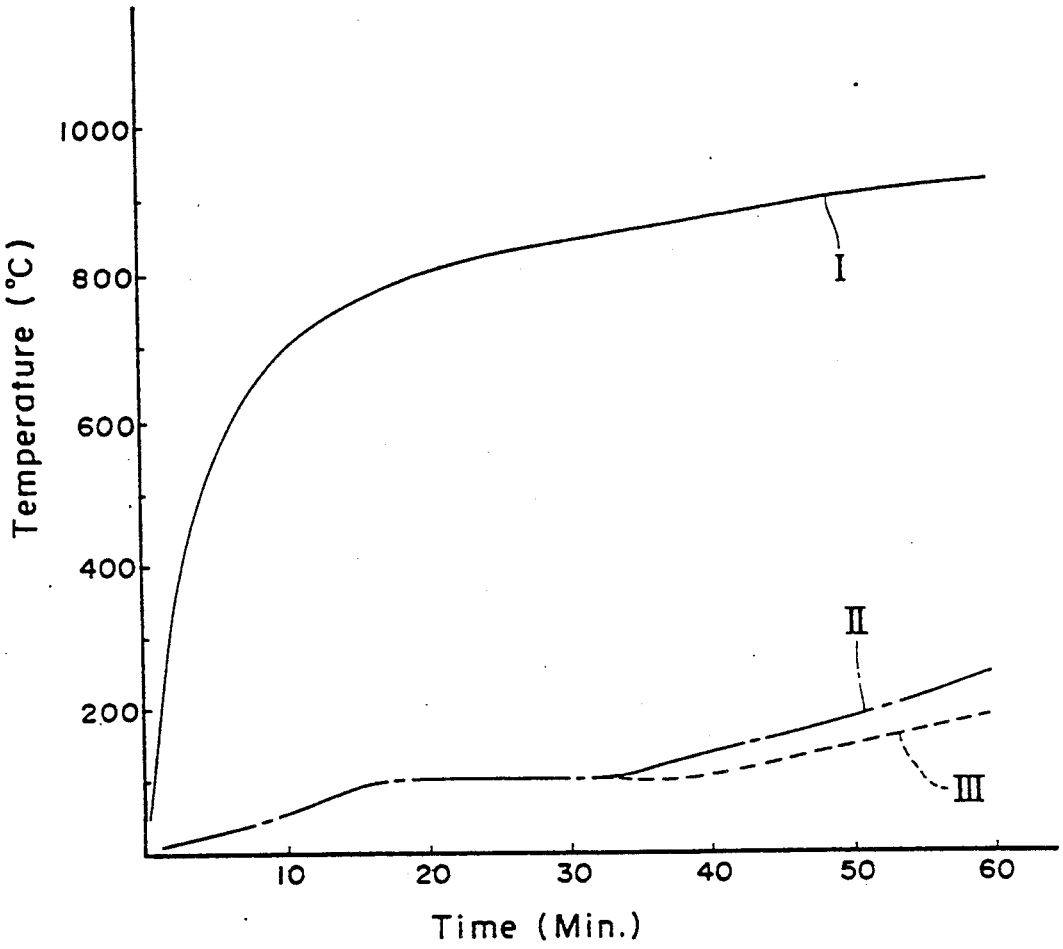
FIG. 3 is a graph showing a temperature curve upon heating test.

In FIG. 3, reference character I shows an average temperature in a furnace on the heating side, II shows an average temperature at the surface of the door specimen 6 on the not-heated side and III shows an average temperature at the gap between the wood frame 1 and the door 6 on the not-heated side respectively. The average temperature shown in Table 1 is an average temperature at the gap described above on the not-heated side.

As a result, elevation of temperature in the gap was limited to 190° C. at the highest in the case of using the wood frame of the present invention, whereas the temperature was elevated up to 260° C. or higher in the comparative case.

Figure 4:
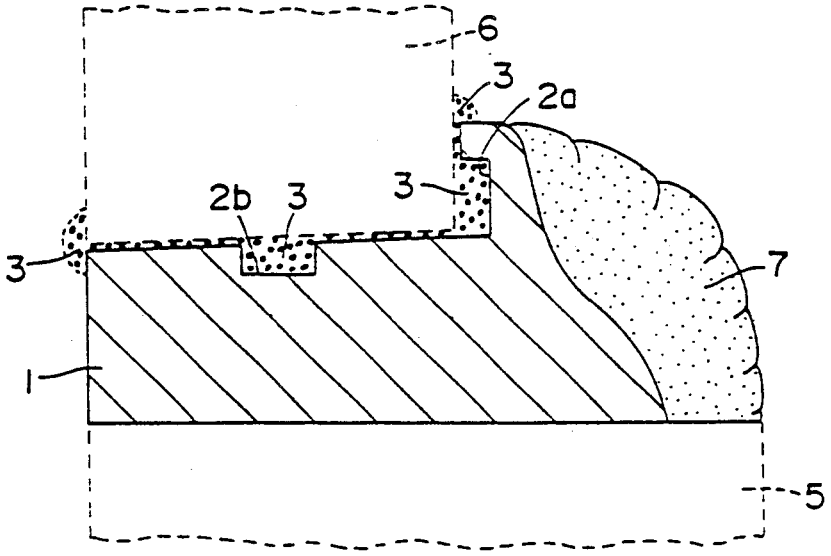
FIG. 4 is a cross sectional view of a wood frame in the specimen after heating test.
Figure 2A:
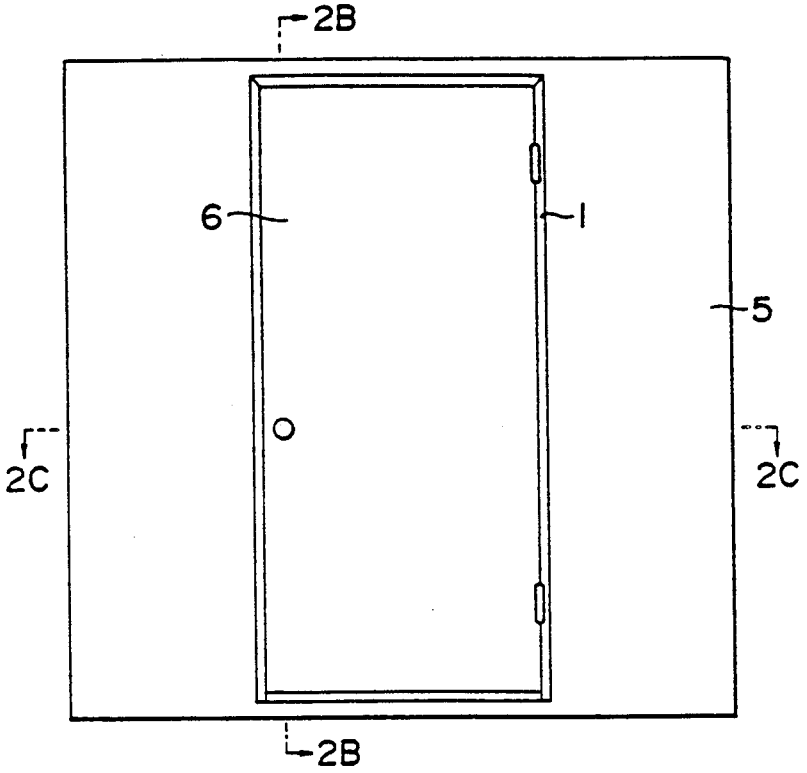
FIG. 2(A) is an explanatory view of a specimen used for heating test.
Figure 2B:
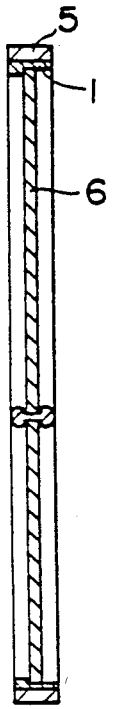
FIG. 2(B) is a cross sectional view taken along line 2B—2B in FIG. 2(A)
Figure 2C:
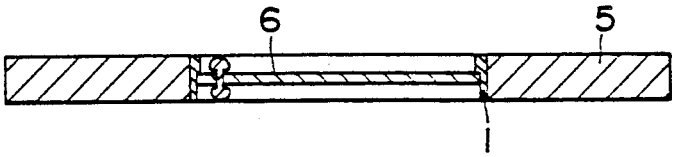
FIG. 2(C) is a cross sectional view taken along line 2C—2C in FIG. 2(A)
Figure 2D:
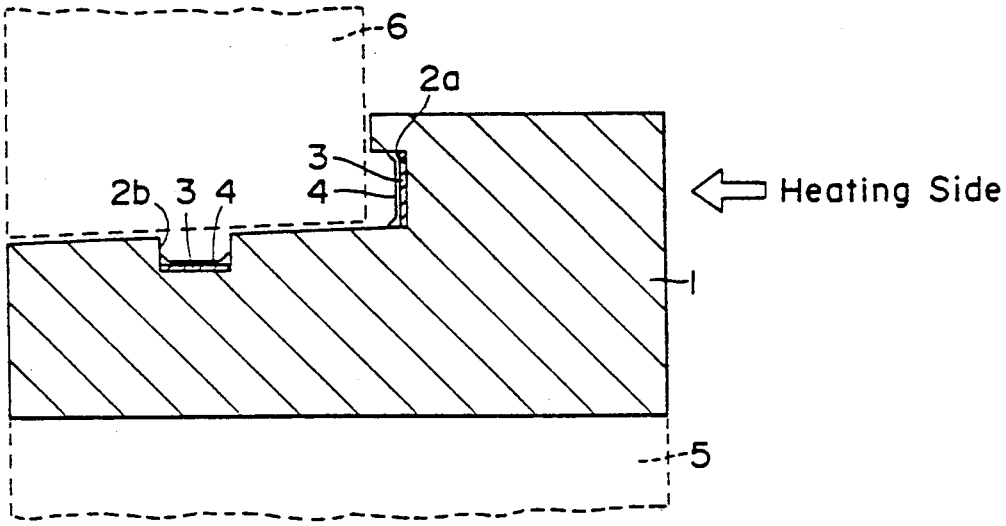
FIG. 2(D) is a cross sectional view for a portion of the wood frame in a specimen.

As a result, it was confirmed that the fireproof effect is not sufficient by merely filling the sealing material under pressure to the groove, but the fireproofness can be extremely improved by covering the surface of the sealing material with the thin film described above, thereby remarkably restraining the elevation of temperature. When the wood frame was checked after the test, the sealing material 3 foamed substantially uniformly at the entire circumference of the gap between the wood frame and the opening member, as shown in FIG. 4, which is considered to be a factor capable of remarkably restraining the temperature rise. In the drawing, reference numeral 7 indicates a carbonized portion.

Further, concentration of smoke leaked to an adjacent room (not-heated side) was measured by using a collecting smoke box and light measuring device based on JIS A 1321, "Testing Method for Incombustibility of Internal Finish Material and Procedure of Buildings". As a result, fuming factor per volume (CA) is small for the frame of the present invention, showing high smoke-resistant effect. The fuming factor is also shown in Table 1.

TABLE 1

| | Heating time | | | |
|---|---|---|---|---|
| | 15 min | | 60 min | |
| Measuring item | Fuming factor (CA) | Average temperature (°C.) | Fuming factor (CA) | Average temperature (°C.) |
| Specimen of the invention | 15 | 105 | 80 | 190 |
| Comparative specimen | 90 | 120 | 120 | 260 or higher |

The foregoing embodiment shows an example of combining a wood frame with a door, but it is apparent that similar results are also obtained by the combination of a wood frame and a window.

As described above, the fireproof frame structure of the present invention using a wood frame has such an advantageous effect of suppressing the elevation of temperature remarkably on the not-heated side and, at the same time, of effectively preventing the discharge of smoke.

What is claimed is:

1. A fireproof frame structure for building opening portions comprising:

an opening member, a wooden frame disposed to a building opening portion, said wooden frame having a groove on a surface of an entire circumference thereof, a non-combustible sealing material filled in said groove which foams upon application of heat and a thin film covering a surface of said sealing material, said thin film having an excellent heat conductivity and being bonded to a surface of said sealing material by self adhesion thereof.

2. A fireproof frame structure according to claim 1, wherein said sealing material is composed mainly of sodium silicate.

3. A fireproof frame structure according to claim 1, wherein said thin film is made of an aluminum foil.

* * * * *